US006318589B1

(12) United States Patent
Simpson

(10) Patent No.: US 6,318,589 B1
(45) Date of Patent: Nov. 20, 2001

(54) METHOD FOR ACTIVATING SCENTS FROM A SCENTED COUPON BY MEANS OF A COUPON DISPENSER

(75) Inventor: Raymond Simpson, Oakpark, IL (US)

(73) Assignee: Menasha Corporation, Neenah, WI (US)

( * ) Notice: Subject to any disclaimer, the term of this patent is extended or adjusted under 35 U.S.C. 154(b) by 0 days.

(21) Appl. No.: 09/521,859

(22) Filed: Mar. 9, 2000

Related U.S. Application Data

(63) Continuation-in-part of application No. 09/130,445, filed on Aug. 6, 1998, now Pat. No. 6,123,221, which is a continuation-in-part of application No. 08/999,846, filed on Oct. 9, 1997, now Pat. No. 5,979,699.

(51) Int. Cl.[7] ..... A47K 10/24
(52) U.S. Cl. ..... 221/45; 221/135
(58) Field of Search ..... 221/33, 45, 46, 221/63, 52, 59, 60, 135; 206/445, 812

(56) References Cited

U.S. PATENT DOCUMENTS 5,165,570 * 11/1992 Windorski et al. ..... 221/46
5,363,985 * 11/1994 Cornell ..... 221/46

* cited by examiner

*Primary Examiner*—Kenneth W. Noland
(74) *Attorney, Agent, or Firm*—Quarles & Brady LLP

(57) ABSTRACT

The present invention discloses a method for dispensing scented coupons in a way that activates the scents as they are removed from a coupon dispenser. Incorporated into one section of the individual scented coupons is a microencapsulated scent. The dispenser comprises walls defining a cavity adapted to receive the stack of sheets, a rectangular flat top wall having an opening through which the sheets may be individually dispensed, a flat bottom wall having approximately the same dimensions as the flat top wall, with the flat bottom wall being approximately parallel to the flat top wall, and resilient means to push the stack of said sheets to the opening in the top wall of the dispenser. As individual, folded scented coupons are removed from the dispenser box, the coupon section having the microencapsulated scent is dragged across the scent release piece in the dispenser, thereby causing the microencapsules to break open allowing more of the scent of the coupons to be released.

29 Claims, 3 Drawing Sheets

METHOD FOR ACTIVATING SCENTS FROM A SCENTED COUPON BY MEANS OF A COUPON DISPENSER

This application is a continuation-in-part of U.S. application Ser. No. 09/130,445, filed Aug. 6, 1998 now U.S. Pat. No. 6,123,221 which is a continuation-in-part of U.S. application Ser. No. 08/999,846 filed on Oct. 9, 1997, now U.S. Pat. No. 5,979,699 for a dispenser box.

BACKGROUND OF THE INVENTION

1. Field of the Invention

The present invention discloses a method for dispensing scented coupons in a way that activates the scents as they are removed from a coupon dispenser.

2. Description of the Prior Art

Over the years, there have been many dispenser boxes developed for the dispensing of sheets of paper or coupons of some sort. This type of device has become more important in the market place as grocery and other stores have installed coupon dispensers on their shelves to give consumers incentives to make impulse purchases based on lower prices given at their stores on any given day of the week.

To accommodate consumer needs, there has been a number of different paper dispensing devices over the years.

U.S. Pat. No. 2,253,742 (W. H. West et al.) discloses a dispenser for interfolded paper. The dispenser comprises a vertically disposed container having a dispensing opening and a spring-actuated follower plate in the container adapted to support a vertically disposed stack of interfolded paper sheets. A plate is secured to the under side of the cover at one side of the dispensing opening, and engages the upper end of the stack while maintaining a predetermined spacing between the stack and the dispensing opening. A second plate is secured to the underside of the cover, the ends of the plates adjacent the dispensing opening being rounded to form deflecting surfaces.

U. S. Pat. No. 5,390,820 (Wright et al.) discloses an elevating dispensing device for flexible sheet material. The dispensing aperture has flaps to retain the end of successively drawn sheets above the aperture for ease of withdrawal. The stack of sheets rests within the carton on an elevating platform which is flexibly attached on two opposing sides to the base of the adjacent side walls of the carton by flexibly folded extension panels which allow upward urging of the elevating platform.

U.S. Pat. No. 2,237,424 (S. N. Hope) discloses a sheet dispenser comprising a casing adapted to contain a pack of interfolded sheets and having opposite end walls with inwardly directed embossments adjacent to the opposite sides of the casing. A pair of cover members extend between the casing end walls and having end walls with outwardly directed embossments adapted to register with the casing embossments. A coiled spring for each cover member urges the cover member against the pack, with the spring surrounding a cooperating pair of the embossments on the casing and cover member.

U.S. Pat. No. 4,993,590 (Windorski), and U.S. Pat. No. 5,165,570 (Windorski et al.) are for dispensers for a stack of partially adhesive coated sheets stacked with the adhesive coating on each successive sheet disposed along alternate opposite sides of the stack and releasably adhering the sheets together.

In U.S. Pat. No. 4,993,590, the dispenser for adhesive coated sheets has opposed end surfaces having parallel upper ends adapted to be engaged by the opposite sides of the stack with the with the top sheets in the stack parallel to the adjacent upper ends, with the opposed end surfaces diverging slightly from each other toward the upper ends of the end surfaces to cause movement of the end portions of the stack along the end surfaces toward the upper ends in response to forces applied to the stack to sequentially remove sheets from the stack through the opening.

U.S. Pat. No. (Simpson) discloses a dispenser box allowing for the removal of individual coupons without the chance of another coupon being removed at the same time. The dispenser comprises walls defining a cavity adapted to receive the stack of sheets, a rectangular flat top wall having an opening through which the sheets may be individually dispensed, a flat bottom wall having approximately the same dimensions as the flat top wall, with the flat bottom wall being approximately parallel to the flat top wall, and resilient means to push the stack of said sheets to the opening in the top wall of the dispenser.

U.S. patent application Ser. No. 09/174,405 (Simpson) now U.S. Pat. No. 6,079,190 discloses a a method for dispensing scented coupons in a way that activates the scents as they are removed from a coupon dispenser. Individual scented coupons have a folded end, with a light adhesive allowing for the On one side of As individual, folded scented coupons are removed from the dispenser box, The dispenser comprises walls defining a cavity adapted to receive the stack of sheets, a rectangular flat top wall having an opening through which the sheets may be individually dispensed, a flat bottom wall having approximately the same dimensions as the flat top wall, with the flat bottom wall being approximately parallel to the flat top wall, and resilient means to push the stack of said sheets to the opening in the top wall of the dispenser.

SUMMARY OF THE INVENTION

The present invention discloses an improved method for dispensing scented coupons in a way that activates the scents as they are removed from a coupon dispenser. Specifically, the dispenser allows scented coupons or pieces of paper to be individually removed without the chance of another coupon being removed at the same time. The scented coupons have a perfume, cologne, or other fragrance, in a slurry, which is preferably encapsulated either along the edges of a fold in the coupon, or in a larger area of the coupon. A rubber or scent release piece positioned at the opening of the dispenser provides an increased level of resistance or abrasive action as the scented coupon is removed from the dispenser, thereby causing more of the microencapsules to break open, allowing more of the scent of the coupons to be released.

Microencapsulation is a process to enclose very small-sized core materials, either solids or liquids, in the coating materials. This technique has played a significant role in a variety of industries for many years. These include pharmaceutical, cosmetic, food, agricultural, plastic, paper, photographic, printing, paint, adhesive and computer industries.

Microencapsulation is a process in which very thin coatings of inert natural or synthetic polymeric materials are deposited around microsized particles of solids or droplets of liquids. Products thus formed are known as microcapsules.

Microcapsules consist of two major parts. The inner part is the core material comprised of one or more active ingredients. These active ingredients may be solids, liquids, or gases. The outer part is the coating material which is usually a high molecular weight polymer or a combination of such polymers. The coating material can be chosen from a wide variety of natural and synthetic polymers.

The coating material must be nonreactive to the core material, preferably biodegradable, and nontoxic. Other components, such as plasticizers and surfactants, may also be added to microcapsules.

The unique feature of microcapsules is the diminutive size of the coated particle the particle size usually ranges from several nanometers to several micrometers. Particles between 1 and 2000 micrometers in diameter are called microcapsules, whereas the products with the diameter smaller than 1 micrometer are referred to as nanocapsules. Various types of physical structures of the product of microencapsulation such as mononuclear spheres, multinuclear spheres, and multinuclear irregular particles, can be obtained depending on the manufacturing process. The most common structure formed is the mononuclear sphere.

The encapsulation of a fragrance protects the core materials against atmospheric deterioration. There is an enhancement of stability of the core materials.

The dispenser is placed in a supermarket, on a shelf, where consumers would remove coupons to get discounts on particular grocery products when they go to the cashier's counter. The scent, could have the aroma of perfume, pizza, chocolate, or any other enticing smell which would entice the shopper to purchase the product in question.

In another embodiment of the invention, the coupon has three sections, wherein one section is folded on top of a second section, with the third section containing the encapsulated scent integral with the second section. As the coupon is removed from the dispenser, by pulling on the first section, the top surface of the third section of the coupon is dragged across the scent release piece, causing the microcapsules to break, and the scent to be released.

In one embodiment of the invention, there is no "divergence" of any possible equivalent end surfaces. The surfaces of the proposed invention are all either perpendicular or parallel to each other, except for the semi-circular piece of styrene that keeps pressure on the coupons so that they stay up against the opening of the box for easy withdrawal from the dispenser. In one embodiment of the invention, the inside of the dispenser is a triangular shape that assists the semi-circular piece of styrene in keeping an upward pressure on the coupons which helps the coupons "sit up" in the dispenser box to allow them to be easily pulled out by a folded edge of the coupon.

In another one embodiment of the invention, the design of the dispenser allows it to be printed, die-cut and folded out of one piece of paper stock.

In yet another embodiment of the invention, the dispenser contains a header piece for hanging on the store shelf and for adding graphics. This header piece can be located on several other panels of the dispenser box.

In another embodiment of the invention, the dispenser may be part of an in-store display. The dispenser may also be part of an in-store easel.

DETAILED DESCRIPTION OF THE INVENTION

Figure 1:
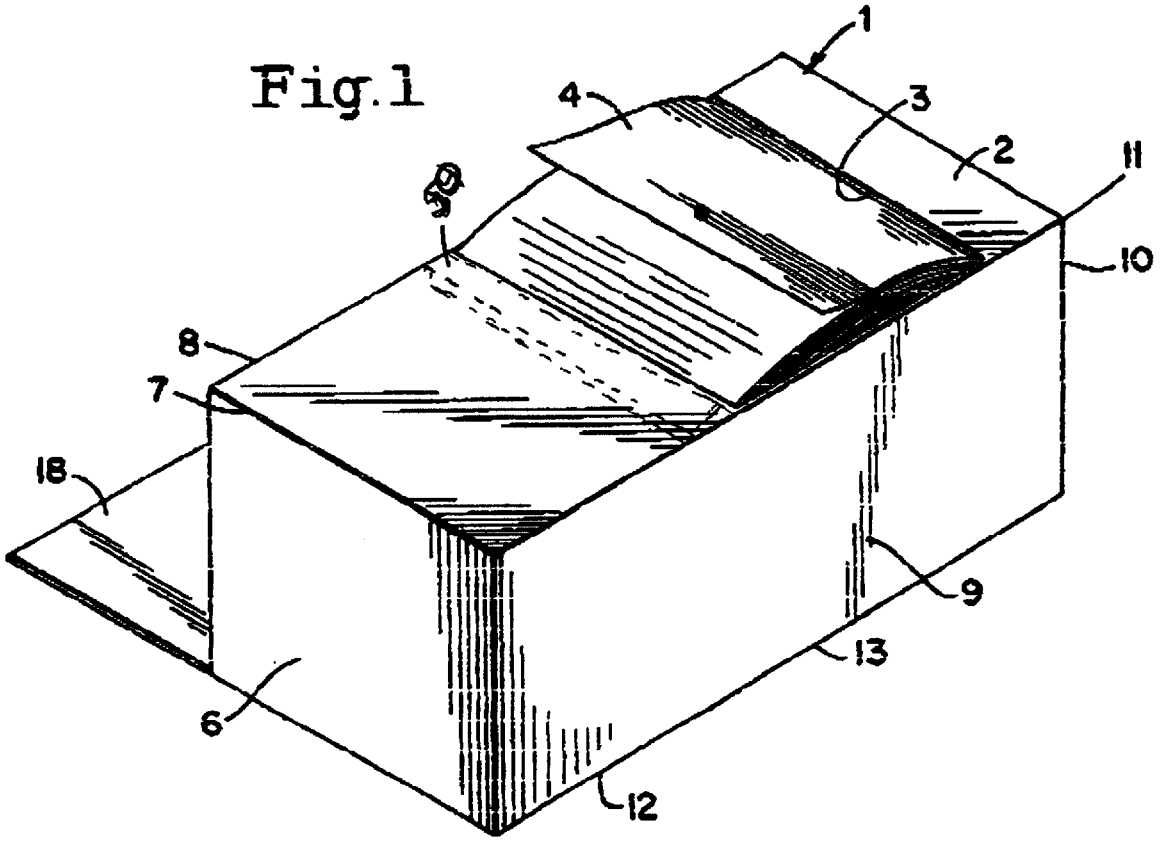
FIG. 1 is a perspective view of the coupon dispenser.
Figure 2:
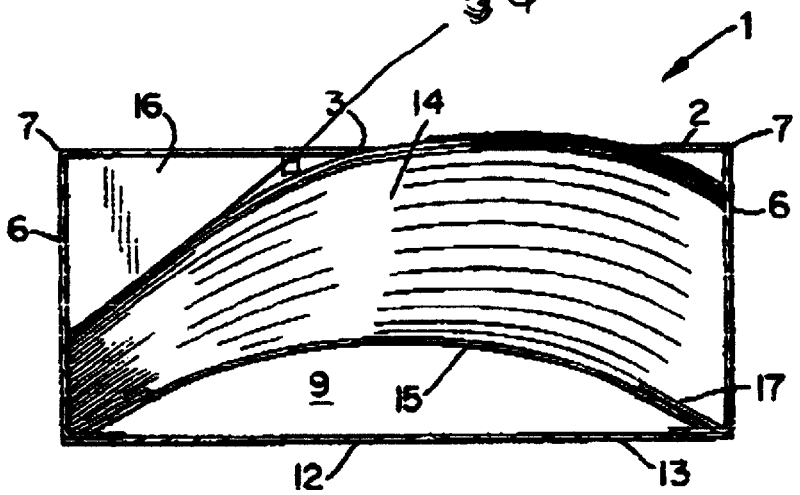
FIG. 2 is a cross-sectional view of the coupon dispenser.
Figure 3:
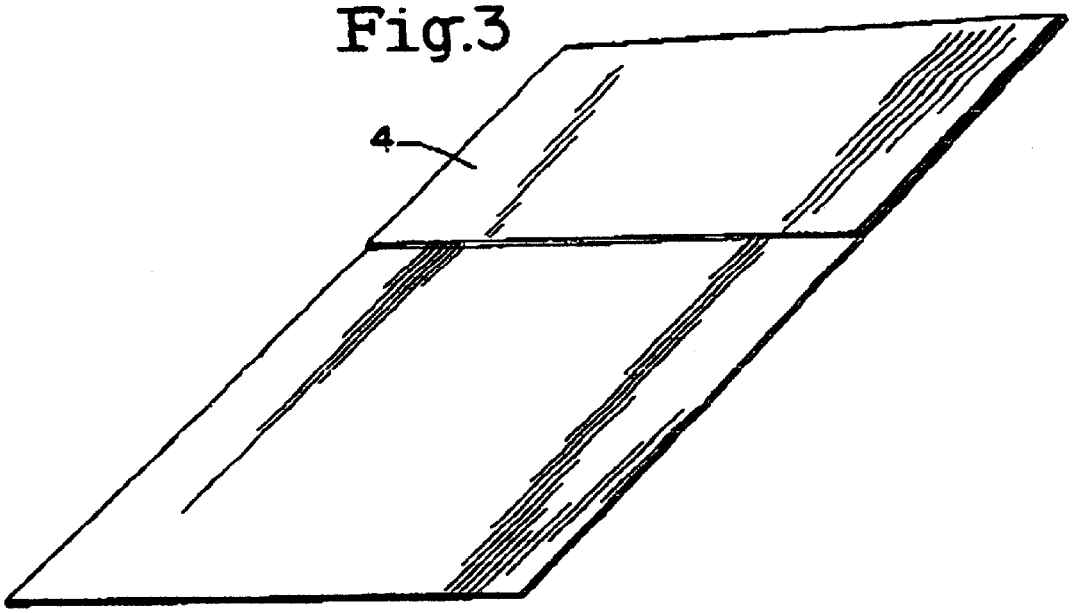
FIG. 3 is a perspective view of one of the coupons.
Figure 4:
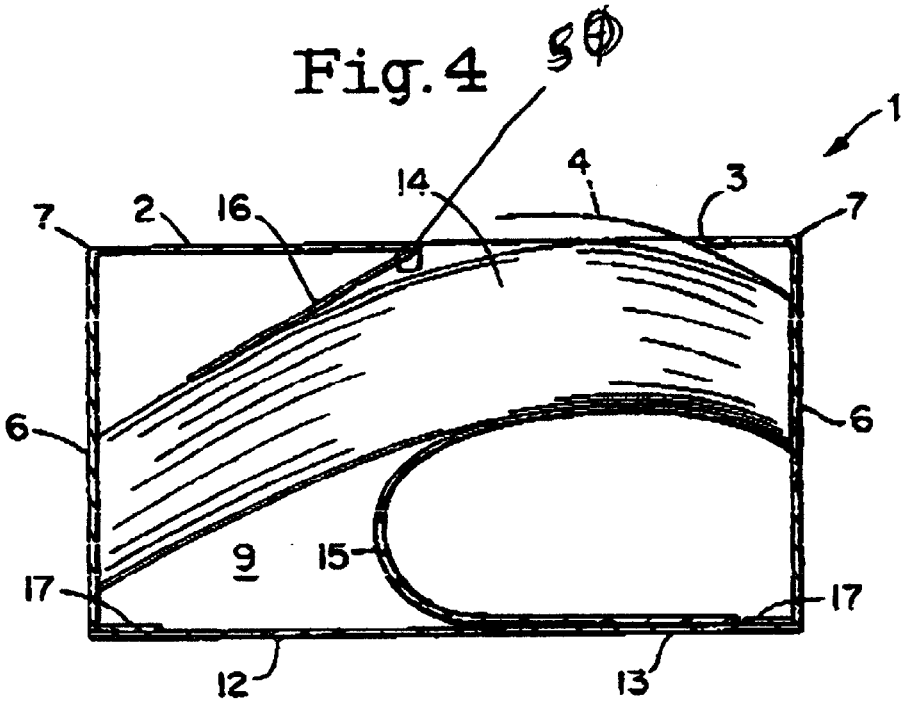
FIG. 4 is a cross-sectional view of the coupon dispenser.
Figure 5:
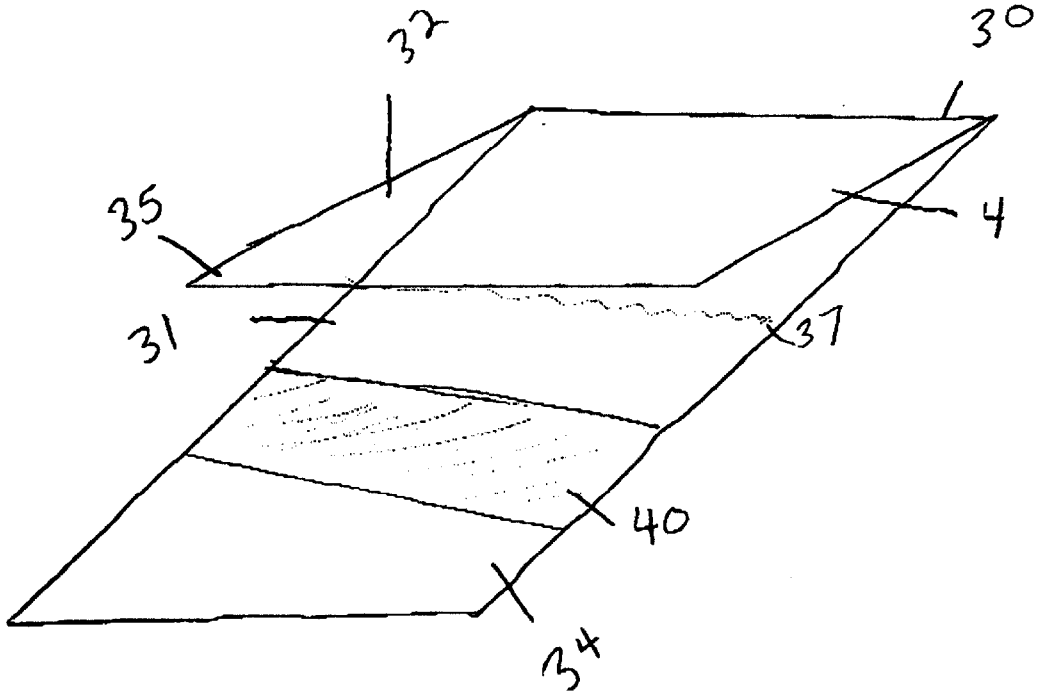
FIG. 5 is a side view of one of the scented coupons.

Referring to FIGS. 1–5, the dispenser 1 is generally rectangular or box shaped, having a large enough interior area to store a number of scented sheets or coupons 4. A rectangular flat top wall 2 has an opening 3 through which the scented coupons or flexible sheets 4 may be dispensed. The walls of the dispenser define a cavity 5 adapted to receive a stack of scented coupons 4 disposed one on top of another and folded at a specific length, allowing for the dispensing the individual scented coupons 4. A rectangular flat top wall 2 has an opening 3 through which the scented coupons 4 may be individually dispensed. On the underside of the flat top wall 2 near the opening 3 is a scent release bar 50 which runs along the width of the opening 3. The bar 50 may be made out of rubber, styrene, plastic, or some other appropriate material.

The dispenser 1 has two short flat end walls 6. Edges 7 of these short flat end walls 6 are positioned perpendicularly to edges 8 of the width of the flat top wall 2 at opposite ends of the flat top wall 2. The two short flat end walls 6 are approximately parallel to each other, with each of the two short flat end walls 6 having the same dimensions as the other flat end wall. In another embodiment of the invention, however, the top corners 60, 61 of the box may be rounded or curved.

Between the two short flat end walls 6 are two long flat side walls 9. The edges 10 of each of the two long flat side walls 9 are positioned along the edges of the length 11 of the top wall 2 with the long flat side walls 9 positioned approximately perpendicular to the flat top wall 2. Each of the long side walls 9 are located on opposite sides of the width of the top wall 2, such that the two long side walls 9 are approximately parallel to each other The dispenser 1 also has a flat bottom wall 12 having approximately the same dimensions as the flat top wall 2, without an opening. The flat bottom wall 12 is approximately parallel to the flat top wall 2, wherein one edge 13 along the length of the flat bottom wall is affixed to the bottom of the dispenser 1. The stack of scented coupons 14 is positioned between the two short end walls 6.

The scented coupons 4 are folded at an edge 30, thereby creating a bottom sheet 31 integrally and continuously connected along the folded edge 30 to a top flap 32. Integral with the bottom sheet 31 of the coupon is the scented section 34 of the coupon. This scent may be along a specific strip 40, or the microencapsulated scent may be evenly distributed over the surface area of the section 34. In one embodiment of the invention, there is a light adhesive 37 between the top flap 32 and the bottom sheet 31. This light adhesive 37 allows the top flap 32 and the bottom sheet 31 to be held together until it is removed from the dispenser 1 by means of the flap 32. A front "tab" section 35 of the flap 32 preferably has no adhesive on its underside, thereby allowing the user of the dispenser to pull the tab 35 to remove the scented coupon 4 from the dispenser 1.

With or without adhesive, the top flap 32 is pulled to remove the coupon from the dispenser 1. As the coupon is removed from the dispenser, the scented section 34 rubs against the scent release bar 50, and the microcapsules which encapsulate the scent are then broken, releasing the scent so that the coupon then has the smell of the scent which was formerly in the microcapsules.

The walls of the dispenser define a cavity 5 adapted to receive the stack of scented coupons 4. The dispenser 1 is generally rectangular or box shaped, having a large enough interior area to store a number of scented sheets or coupons 4. A rectangular flat top wall 3 has an opening 3 through which the scented coupons 4 may be individually dispensed.

In a preferred embodiment of the invention, a resilient means is used to push the stack of scented coupons 14 up to the opening 3 in the top wall 2 of the dispenser 1. In one embodiment of the invention, the means to push the scented coupons to the opening of the dispenser is an arc type structure 15 positioned underneath the stack of scented coupons 14. This arc type structure 15 is positioned between the short end walls 6 and above the flat bottom wall 12. The peak of the arc type structure 15 is in communication with the stack of scented coupons 14, pushing the stack of scented coupons 14 towards the opening 3 in the dispenser 1. In another embodiment of the invention, the arc type structure 15 may be flexed and inserted between the stack of scented coupons 14 and the bottom wall 12.

Another preferred feature of the dispenser directs the stack of scented coupons towards the opening in the top wall of the dispenser. More preferably, this feature is an angular formation 16 positioned between one of the end walls 6 and the top wall 2, to direct the stack of scented coupons 14 towards the opening 3 in the top wall 2 of the dispenser 1. Preferably, this angular formation 16 is a triangular shaped piece 16 positioned between the end wall 6 and the top wall 2. This triangular shaped piece is most preferably in the form of a right triangle which fits into one of the top corners of the dispenser 1. In a more preferable embodiment of the invention, the angular formation 16 is the material from opening 3 folded back toward wall 6.

The exterior walls of the dispenser 1 may be made out of one unitary piece of material wherein the material is selected from the group consisting of paper, styrene, and plastic. In line with this arrangement, it is a preferred embodiment to have flaps or tongues 17 on one edge of each wall so that the unitary piece of material may be folded into the box like dispenser. In such an arrangement, the bottom wall of the device may be secured in place to an overlapping flap or tongue by means of an adhesive of some sort such as tape or glue. In yet another embodiment of the invention, the box may have slits 17 into which the flaps or tongues are inserted to hold the dispenser 1 in its box-like shape.

The dispenser may also have a header 18 for displaying the dispenser 1. This header 18 may be positioned along virtually any wall or edge of the dispenser 1 but it is most preferable to have the header positioned along the same plane as that of the bottom section 12, to allow for the display of the dispenser 1.

In another embodiment of the invention, the two side walls 70, 71 may be angularly positioned; however, the two short flat end walls 80, 81 would have to be sized accordingly, as well as the top and bottom walls 90, 91, coupons 100 and resilient member 101.

Many modifications and variations of the present invention are possible in light of the above teachings. It is, therefore, to be understood within the scope of the appended claims the invention may be protected otherwise than as specifically described.

What is claimed is:

1. A method for dispensing and activating scented coupons as they are removed from a coupon dispenser, said method comprising:

a) stacking said scented coupons in the coupon dispenser, each said scented coupon comprising: a bottom sheet, an edge, a top flap integrally and continuously connected along the folded edge to said bottom sheet and a scented section integral with the bottom sheet, said scented section having a microenscapsulated scent, said coupon dispenser comprising:

a rectangular flat top wall having an opening through which said sheets may be individually dispensed;

two short flat end walls, wherein edges of each of said two short flat end walls are positioned perpendicularly to edges of the width of said flat top wall at opposite ends of said flat top wall, wherein said two short flat end walls are parallel to each other and each said short flat end wall has the same dimensions as the other flat end wall;

two long flat side walls wherein edges of each of said two long flat side walls are positioned perpendicularly to edges of the length of said flat top wall at opposite sides of said flat top wall, wherein said two long flat side walls are parallel to each other and each said long flat side wall has the same dimensions as the other long flat side wall;

a flat bottom wall having approximately the same dimensions as the flat top wall, said flat bottom wall being approximately parallel to said flat top wall, wherein at least one edge along the length of said flat bottom wall is affixed to the bottom of said dispenser; and a scent release piece, positioned on the underside of the flat top wall, along the width of the opening of the dispenser; and b) pulling said top flap from the bottom sheet to remove said scented coupon from said dispenser, said pulling causing said scented section of said coupon to be dragged against said scent release piece, thereby breaking the microcapsules of said coupon and releasing the scent as the scented coupon is removed from the dispenser.

2. The method for dispensing the scented coupons of claim 1, further comprising pushing said stack of said scented coupons sheets to the opening in the top wall of the dispenser by a resilient device.

3. The method for dispensing the scented coupons of claim 2, wherein said resilient device to push said stack of said scented coupons to the opening in the top wall of the dispenser is an arc type structure positioned underneath said stack of sheets, said arc type structure positioned between said short flat end walls and above said flat bottom wall, wherein said arc type structure is in communication with said stack of scented coupons, pushing said stack of sheets towards the opening in said flat top wall.

4. The method for dispensing the scented coupons of claim 2, wherein said resilient device to push said stack of said scented coupons to the opening in the top wall of the dispenser is an arc type structure positioned underneath said stack of said scented coupons, said arc type structure positioned between said stack of said scented coupons and above said flat bottom wall, wherein one end of said arc type structure is in communication with said stack of said scented coupons, pushing said stack of said scented coupons towards the opening in said flat top wall.

5. The method for dispensing the scented coupons of claim 1, further comprising directing said stack of said scented towards the opening in the top wall of the dispenser.

6. The method for dispensing the scented coupons of claim 4, further comprising an angular formation positioned between one of said end walls and said top wall, for the purpose of directing said stack of said scented coupons towards said opening in the top wall of the dispenser.

7. The method for dispensing the scented coupons of claim 6, further comprising a triangular shaped piece positioned between one of said end walls and said top wall, for the purpose of directing said stack of said scented coupons towards said opening in the top wall of the dispenser.

8. The method of dispensing the scented coupons of claim 6, wherein said angular formation is the material from said opening folded back toward said wall.

9. The method of dispensing the scented coupons of claim 1, wherein said dispenser is made of one unitary piece of material.

10. The method of dispensing the scented coupons of claim 1, further comprising side flaps positioned on a bottom section of at least one of said walls.

11. The method of dispensing the scented coupons of claim 1, wherein said dispenser is comprised of a material selected from the group consisting of paper, styrene, and plastic.

12. The method for dispensing the scented coupons of claim 1, wherein said scented coupons are independent of each other.

13. The method for dispensing the scented coupons of claim 1, wherein said scent is microencapsulated.

14. The method for dispensing the scented coupons of claim 1, comprising placing the scent is may be along a specific strip between the top flap and the bottom sheet.

15. The method for dispensing the scented coupons of claim 1, wherein said scented coupons further comprise a front tab section on said top flap.

16. A dispenser for dispensing and activating scented coupons as they are removed from a coupon dispenser, allowing for the dispensing of individual sheets, said dispenser comprising:

walls defining a cavity adapted to receive the stack of said sheets, said walls including:

a rectangular flat top wall having an opening through which said sheets may be individually dispensed;

two short flat end walls, wherein edges of each of said two short flat end walls are positioned perpendicularly to edges of the width of said flat top wall at opposite ends of said flat top wall, wherein said two short flat end walls are parallel to each other and each said short flat end wall has the same dimensions as the other flat end wall:

two long flat side walls wherein edges of each of said two long flat side walls are positioned perpendicularly to edges of the length of said flat top wall at opposite sides of said flat top wall, wherein said two long flat side walls are parallel to each other and each said long flat side wall has the same dimensions as the other long flat side wall;

a flat bottom wall having approximately the same dimensions as the flat top wall, said flat bottom wall being approximately parallel to said flat top wall, wherein at least one edge along the length of said flat bottom wall is affixed to the bottom of said dispenser;

a resilient flexible arc type structure, said arc type structure having essentially a solid rectangular shape when flat, said arc type structure pushing said stack of said sheets to the opening in the top wall of the dispenser, said arc type structure positioned underneath said stack of sheets, said arc type structure positioned between said short flat end walls and above said flat bottom wall, wherein said arc type structure is in communication with said stack of sheets, pushing said stack of sheets towards the opening in said flat top wall;

a scent release piece, positioned on the underside of the flat top wall, along the width of the opening of the dispenser; and a stack of said scented coupons, said scented coupons comprising a bottom sheet, an edge, a top flap integrally and continuously connected along the folded edge to said bottom sheet and a scented section integral with the bottom sheet, said scented section having a microenscapsulated scent, said stack of said scented coupons being positioned between said two short end walls within said dispenser, wherein when pulling said top flap from the bottom sheet to remove said scented coupon from said dispenser, said pulling causes said scented section of said coupon to be dragged against said scent release piece, thereby breaking the microcapsules of said coupon and releasing the scent as the scented coupon is removed from the dispenser.

17. The dispenser of claim 16, further comprising an angular formation positioned between one of said end walls and said top wall, for the purpose of directing said stack of said sheets towards said opening in the top wall of the dispenser.

18. The dispenser of claim 17, wherein said dispenser is made of one unitary piece of material, aside from the arc type structure.

19. A dispenser for dispensing scented coupons from a stack of coupons disposed one on top of another, said dispenser comprising:

walls defining a cavity adapted to receive the stack, said walls including:

a rectangular flat top wall having an opening through which said dispenser may be individually dispensed, two short flat end walls, wherein edges of each of said two short flat end walls are positioned perpendicularly to edges of the width of said flat top wall at opposite ends of said flat top wall, wherein said two short flat end walls are parallel to each other and each said short flat end wall has the same dimensions as the other flat end wall:

two long flat side walls wherein edges of each of said two long flat side walls are positioned perpendicularly to edges of the length of said flat top wall at opposite sides of said flat top wall, wherein said two long flat side walls are parallel to each other and each said long flat side wall has the same dimensions as the other long flat side wall;

a flat bottom wall having approximately the same dimensions as the flat top wall, said flat bottom wall being approximately parallel to said flat top wall, wherein at least one edge along the length of said flat bottom wall is affixed to the bottom of said dispenser;

a resilient element to push said stack of scented coupons to the opening in the top wall of the dispenser, said means being an arc type structure positioned underneath said stack of scented coupons and between said stack of scented coupons and the flat bottom wall, wherein one end of said arc type structure is in communication with said stack of scented coupons, pushing said stack of scented coupons towards the opening in said flat top wall;

an angular formation positioned between one of said end walls and said top wall, for the purpose of directing said stack of said scented coupons towards said opening in the top wall of the dispenser, wherein said angular formation is the material from said opening folded back toward said wall, and wherein said stack of said of scented coupons is positioned between said two short end walls within said dispenser;

a stack of said scented coupons, said scented coupons comprising a bottom sheet, an edge, a top flap integrally and continuously connected along the folded edge to said bottom sheet and a scented section integral with the bottom sheet, said scented section having a microenscapsulated scent; and a scent release piece, positioned on the underside of the flat top wall, along the width of the opening of the dispenser, such that when pulling said top flap from the bottom sheet to remove said scented coupon from said dispenser, said pulling causes said scented section of said coupon to be dragged against said scent release piece, thereby breaking the microcapsules of said coupon and releasing the scent as the scented coupon is removed from the dispenser.

20. A dispenser for dispensing individual scented coupons from a stack of scented coupons disposed on top of another, said dispenser comprising:

walls defining a cavity adapted to receive the stack, said walls including:

a rectangular flat top wall having an opening through which said sheets may be individually dispensed;

two short flat end walls, wherein edges of each of said two short flat end walls are positioned perpendicularly to edges of the width of said flat top wall at opposite ends of said flat top wall, wherein said two short flat end walls are parallel to each other and each said short flat end wall has the same dimensions as the other flat end wall:

two long flat side walls wherein edges of each of said two long flat side walls are positioned perpendicularly to edges of the length of said flat top wall at opposite sides of said flat top wall, wherein said two long flat side walls are parallel to each other and each said long flat side wall has the same dimensions as the other long flat side wall;

a flat bottom wall having approximately the same dimensions as the flat top wall, said flat bottom wall being approximately parallel to said flat top wall, wherein at least one edge along the length of said flat bottom wall is affixed to the bottom of said dispenser;

side flaps positioned on a bottom section of at least one of said walls, wherein said stack of said sheets is positioned between said two short end walls within said dispenser;

a stack of said scented coupons, said scented coupons comprising a bottom sheet, an edge, a top flap integrally and continuously connected along the folded edge to said bottom sheet and a scented section integral with the bottom sheet, said scented section having a microenscapsulated scent;

a scent release piece, positioned on the underside of the flat top wall, along the width of the opening of the dispenser, such that when pulling said top flap from the bottom sheet to remove said scented coupon from said dispenser, said pulling causes said scented section of said coupon to be dragged against said scent release piece, thereby breaking the microcapsules of said coupon and releasing the scent as the scented coupon is removed from the dispenser.

21. The dispenser of claim 20, further comprising a resilient element to push said stack of scented coupons to the opening in the top wall of the dispenser, said element being an arc type structure positioned underneath said stack of scented coupons and between said stack of scented coupons and the flat bottom wall, wherein one end of said arc type structure is in communication with said stack of scented coupons, pushing said stack of scented coupons towards the opening in said flat top wall.

22. The dispenser of claim 21, wherein an apex of said arc type structure is in communication with the bottom of said stack of sheets.

23. The dispenser of claim 21, wherein one side of end of said arc type structure is in communication with the bottom of said stack of sheets, wherein an apex of said arc type structure is facing one of said side walls.

24. The dispenser of claim 20, further comprising an angular formation positioned between one of said end walls and said top wall, for the purpose of directing said stack of said sheets towards said opening in the top wall of the dispenser.

25. The dispenser of claim 24, further comprising a triangular shaped piece positioned between one of said end walls and said top wall, for the purpose of directing said stack of said sheets towards said opening in the top wall of the dispenser.

26. The dispenser of claim 21, wherein said angular formation is the material from said opening folded back toward said wall.

27. The dispenser of claim 20, wherein said dispenser is made of one unitary piece of material.

28. The dispenser of claim 20, further comprising side flaps positioned on a bottom section of at least one of said walls.

29. The dispenser of claim 20, further comprising a header for displaying said dispenser.

* * * * *